United States Patent [19]

Szukhent, Jr.

[11] 4,379,468

[45] Apr. 12, 1983

[54] VENTILATOR APPARATUS FOR A FLEXIBLE SHEET

[75] Inventor: Steve Szukhent, Jr., Montrose, Mich.

[73] Assignee: Tex-All Company, Inc., Montrose, Mich.

[21] Appl. No.: 221,214

[22] Filed: Dec. 30, 1980

[51] Int. Cl.[3] ..... A45F 1/08

[52] U.S. Cl. ..... 135/88; 135/93

[58] Field of Search ..... 135/6, 14 V, 14 R, 1 D, 135/1 R, 1 C, 4 B, 3 R, 2

[56] References Cited

U.S. PATENT DOCUMENTS

| | | | |
|---|---|---|---|
| 546,978 | 9/1895 | Williams | 135/14 V |
| 731,319 | 6/1903 | McIntyre | 135/1 D |
| 833,411 | 10/1906 | Ormsby | 135/3 R |
| 1,428,343 | 9/1922 | Runice | 135/14 V |
| 1,592,356 | 7/1926 | Goldberg et al. | 135/1 D |
| 2,314,830 | 3/1943 | Hunter | 135/1 D |
| 2,907,261 | 10/1959 | Traub | 135/14 V |
| 3,453,786 | 7/1969 | Rebarchek | 135/3 D |

*Primary Examiner*—Richard C. Pinkham
*Assistant Examiner*—T. Brown
*Attorney, Agent, or Firm*—John J. Swartz

[57] ABSTRACT

A ventilator for a boat mooring cover or the like including a support plate on the underside of the cover and a cover plate on the outer side of the cover. The support plate and cover each include passages therein in fluid communication with each other and with an aperture provided in the cover. An extensible and retractible support is provided for adjustably positioning the ventilator at different levels. The support plate includes an annular groove while the cover plate includes an annular detent or clamping rib which cooperates with the groove in the support plate to pinch and displace a portion of the cover therebetween to attach the ventilator to the cover.

10 Claims, 4 Drawing Figures

VENTILATOR APPARATUS FOR A FLEXIBLE SHEET

BACKGROUND OF THE INVENTION

1. Field of the Invention

This invention relates to ventilating apparatus for a boat cover or the like and mechanism for vertically adjusting the ventilating apparatus.

2. Description of Prior Art

Stored recreational vehicles, such as boats, motorcycles and snowmobiles are conventionally covered by a protective sheet of canvas or the like. In a covered boat, for example, condensation frequently occurs beneath the cover due to a temperature differential on opposite sides of the cover. The condensation will enhance deterioration of articles located beneath the cover. Accordingly, it is an object of the present invention to provide new and improved ventilating apparatus for reducing the incidence of condensation on the inside of such a cover.

Ventilation could be accomplished by merely providing an aperture in the cover but such an aperture would permit rain, snow, and other foreign substances to pass to the inside of the cover. Accordingly, it is an object of the present invention to provide a new and novel ventilating apparatus for use in combination with a cover sheet, which will permit the passage of ventilating air but will inhibit the passage of rain, snow, and the like to the inside of the cover.

A mooring cover for a boat, for example, frequently is attached, about the perimeter thereof, to the perimetral portions of the boat. The cover, which sometimes comprises, canvas, will stretch and sag at the mid-portion thereof. Rain water and the like will collect in the sagging mid-portion and cause deterioration thereof. It is an object of the present invention, therefore, to provide ventilating apparatus of the type described which can be mounted on a cover sheet and an extensible and retractible prop coupled to the ventilating apparatus for rendering the cover taut.

It is another object of the present invention to provide ventilating apparatus for a flexible sheet, such as a boat cover, and mechanism for supporting the ventilator apparatus in any one of a plurality of vertically spaced positions to elevate the portion of the cover adjacent the ventilator apparatus above the remaining portions of the cover.

Still another object of the present invention is to provide ventilator apparatus of the type described for a flexible cover sheet having an aperture therethrough including a support member which is mounted on the inside of the sheet and has a passage in fluid communication with the aperture, a cover mounted on the outside of the sheet and having a passage in fluid communication with the aperture, and mechanism coupling the support to the cover to sandwich a portion of the sheet adjacent the aperture therebetween.

Other objects and advantages of the present invention will become apparent to those of ordinary skill in the art as the description thereof proceeds.

SUMMARY OF THE INVENTION

Ventilator apparatus for a flexible sheet, such as a boat covering, having inner and outer sides and a ventilation aperture therethrough comprising a cover sheet for covering the outer side of the opening and having at least one passage therein for communicating ambient air to the aperture, and extensible and retractable support mechanism for supporting the ventilator apparatus at any selected one of a plurality of different levels to position the portion of the sheet adjacent the aperture at any selected one of a plurality of different levels above the edge portions of the sheet.

The present invention may more readily be understood by reference to the accompanying drawings, in which.

DESCRIPTION OF THE PREFERRED EMBODIMENT

Figure 1:
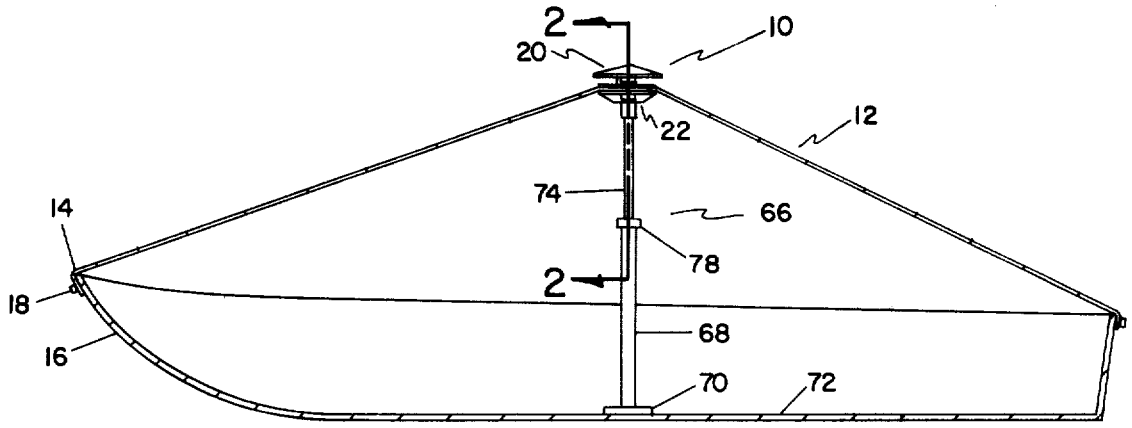
FIG. 1 is a sectional side view illustrating apparatus, constructed according to the present invention, mounted on a cover for a boat.
Figure 2:
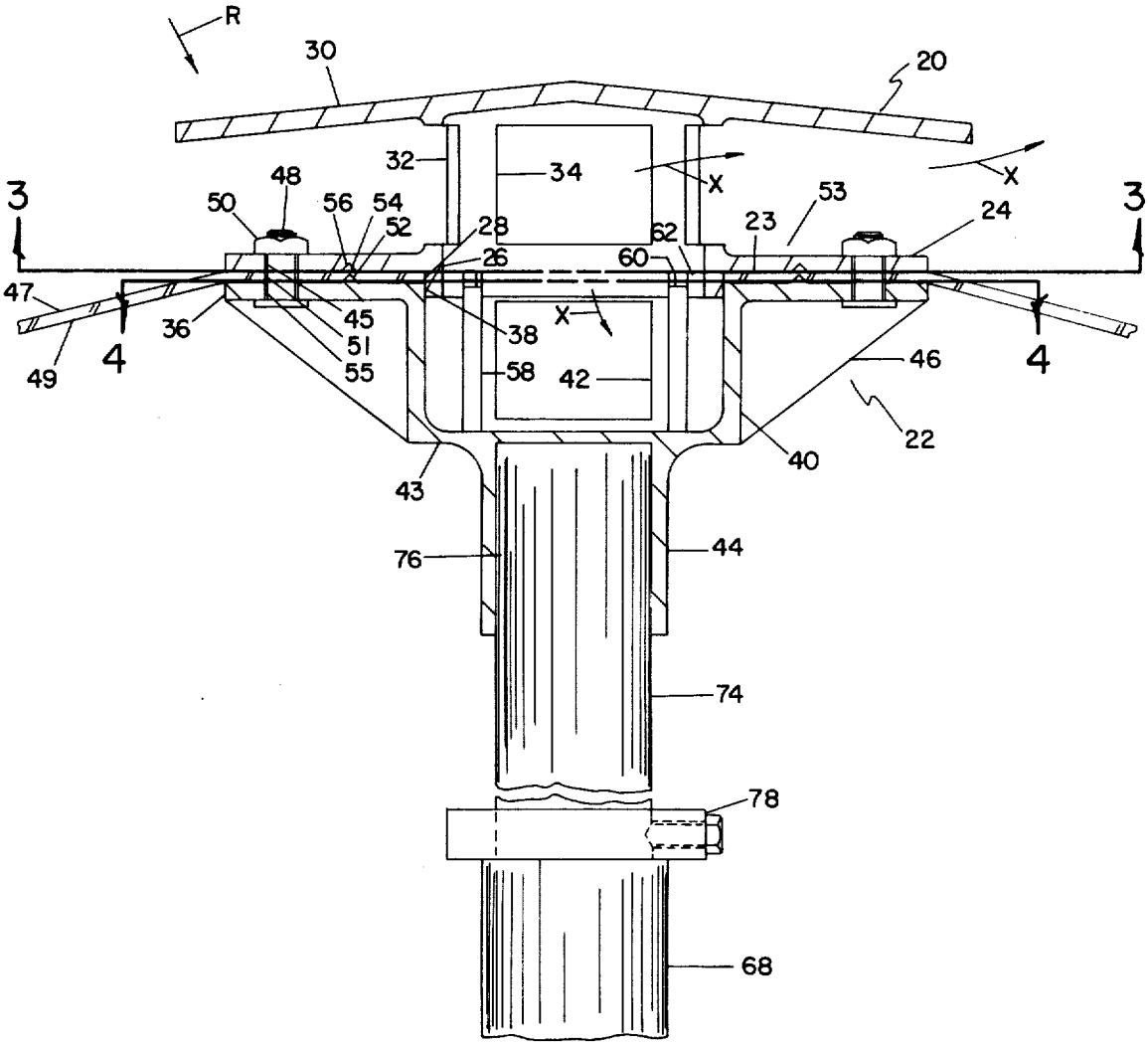
FIG. 2 is a greatly enlarged, sectional end view, taken along the line 2—2 of FIG. 1.
Figure 3:
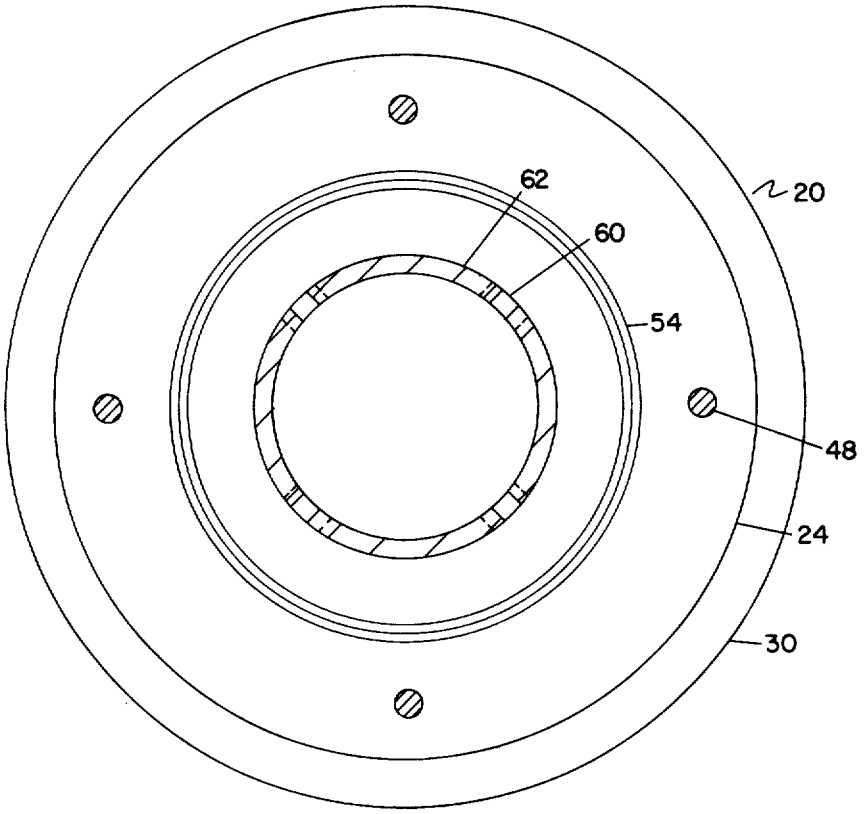
FIG. 3 is a sectional bottom plan view taken along the line 3—3 of FIG. 2.
Figure 4:
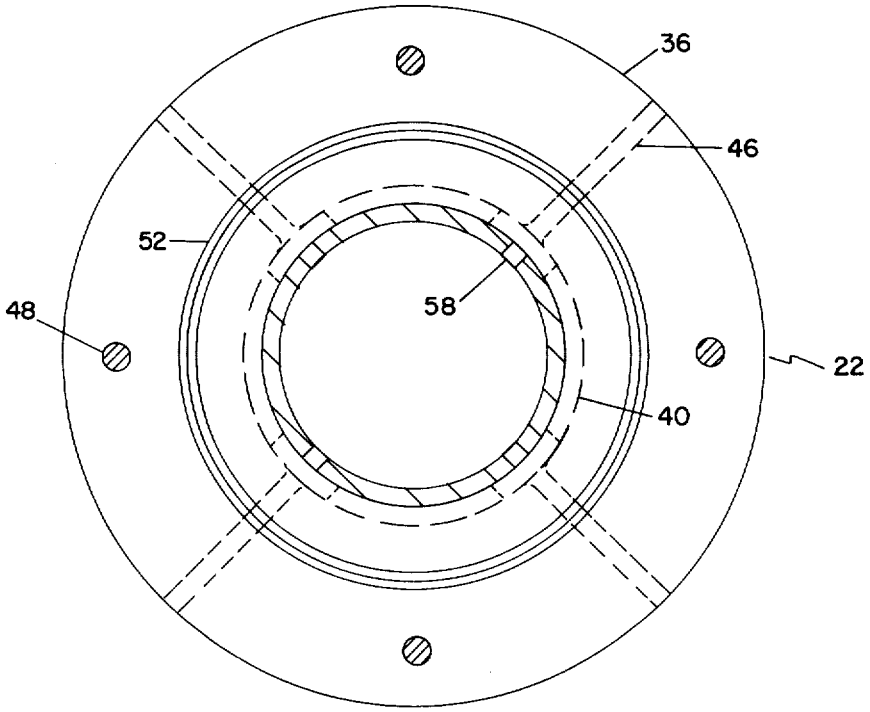
FIG. 4 is a top plan sectional view, taken along the line 4—4 of FIG. 2.

Apparatus constructed according to the present invention, generally designated 10, is particularly adapted for use with a boat cover, generally designated 12, having edge portions 14 removably coupled to a boat 16 via snap fasteners 18 in the usual fashion. The cover 12 may comprise canvas or other suitable textile material.

The ventilating apparatus 10 includes an upper or outer ventilating section, generally designated 20, and a lower or inner support section, generally designated 22. The outer ventilating section 20 includes an annular plate 24 defining an aperture 26 which is aligned with a ventilating aperture 28 provided in midportion 23 of the boat cover 12. The outer ventilating section 20 also includes a conically shaped roof 30 mounted in spaced relation with the plate 24 via an integral hollow cylinder 32 having a plurality of circumferentially spaced, radially outwardly openings apertures 34 therein.

The inner or lower support section 22 includes an annular mounting plate 36 defining an aperture 38 in alignment with the ventilating aperture 28 provided in the cover section aperture 26. An integral hollow cylindrical portion 40 depends from the annular plate 36 and includes a plurality of circumferentially spaced apart, air transmitting apertures 42 therein. The hollow cylindrical portion 40 includes a bottom closure wall 43 mounting a hollow downwardly opening tube 44 thereon. A plurality of circumferentially spaced gussets 46 span the sidewall of the cylinder 40 and the underside of the plate 36, as illustrated.

The annular plates 24 and 36 which bear against the outer and inner cover surfaces 47 and 49 respectively, are coupled together via bolts 48 and nuts 50 to sandwich the sheet portion 23, surrounding the aperture 28, therebetween.

The lower plate 36 includes an annular, sheet pinching or clamping rib or detent 52 which displaces a portion 54 of the central sheet portion 23 into a complimentally formed annular recess or detent receiving 56 provided in the underside of the annular plate 24.

The radially inner side of the lower hollow cylinderical section 40 includes a plurality of circumferentially spaced, axially extending aligning projections or ribs 58 which are received in complimentally formed circumferentially spaced recesses 60 provided in the terminal end of the hollow cylinder 32.

An extensible, and retractable support pole, generally designated 66, is provided and includes a lower cylindrical section 68 mounted on a plate 70 which bears against the bottom wall 72 of the boat 16. The support pole 66 also includes a rod 74 telescopically received by the cylindrical section 68 and an upper portion 76 received by the mounting tube 44 provided on the underside of the lower support member 22. A clamp, generally designated 78, is provided for releasably coupling the telescoping section 68 and 74 in any one of a plurality of different telescoping positions to selectively elevate the ventilating apparatus 10 to any selected one of a plurality of different vertical positions and thus elevate the portion 53 of the cover sheet 12, adjacent the aperture 28, to a level above the adjacent edge portions 14. By adjusting the support rod 74 relative to the cylinder 68, the sheet 12 may be maintained taut and thus inhibit the collection of rainwater, which might otherwise occur if the central sheet poriton 23 were permitted to sag.

THE OPERATION

The lower or inner support section 22 is disposed on the inner surface 49 of the sheet 12 and the outer or cover section 20 is mounted on the outer or upper surface 47 of the sheet 12 such that the apertures 26 and 38 are in alignment with each other and in alignment with the cover aperture 28. Bolts 48 are mounted in the aligned apertures 45, 55 and 51 provided in the upper plate 24, lower plate 36, and cover 12 respectively. The nuts 50 are turned on the bolts 48 to clamp the annular plates 24 and 36 to the mid-portion 23 of the cover sheet 12. As the plates 24 and 36 are clamped to the mid-portion 23 of the cover 12, the sandwiched sheet portion 54 of the sheet 12 is displaced out of the plane of the balance of the sheet into the recess 56 via the crimping ring 52. The crimping ring 52 will inhibit the tearing of the cover 12 which might otherwise occur.

The mounting pole 66 is positioned on the inside of the boat with the upper rod end 76 being received by the lower mounting cylinder 44. The cover 12 is then partially secured to the boat 16 via the snap fasteners 18. The mounting pole sections 68 and 74 are then extended to elevate the ventilating apparatus 10 and render the boat cover 12 taut. The annular rim 52 and recess 56 in effect "bite" the cover so that the cover portion 53 will not pull out from between the plates 24 and 36 when the support pole 66 is extended. The remainder of the snap fasteners 18 are then secured. If the cover 12 is not taut, a portion of the snap fasteners 18 may be released and the pole 66 further extended to properly position the cover portion 53. The fasteners 18 are then resecured.

In the event of a disparity in temperature between the inner and outer surfaces of the canvas 12, the ventilating apparatus 10 permits the free flow of air in the direction of the arrows X. The cover plate 30 will prevent rain, snow and the like, represented by the arrow R from directly entering into the aperture 28.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. Ventilator apparatus for a flexible sheet, such as a boat covering, having a ventilation aperture through a portion of said sheet intermediate edge portions of said sheet, said covering having inner and outer sides, said apparatus comprising:

cover means for covering said ventilation aperture, said cover means having at least one passage therein for communicating ambient air to said aperture;

an inner support section for bearing against the inner side of said sheet, having at least one passage therein in fluid communication with said ventilation aperture and said first mentioned passage;

means for coupling said cover means and said lower section together to clamp said cover means and said lower section to said outer and inner sides, respectively, of said sheet;

one said cover means and said inner section including a projecting sheet clamping rib and the other of said cover means and said inner section including a recess for receiving said rib to clamp a portion of said sheet therebetween; and extensible and retractable support means coupled to said inner support section for supporting said ventilator apparatus at any selected one of a plurality of different levels to position the portion of said sheet adjacent said aperture at any selected one of a plurality of different levels relative to the edge portions of said sheet.

2. Ventilator apparatus for a flexible sheet, such as a boat covering, having a ventilation aperture through a portion of said sheet intermediate edge portions of said sheet, said covering having inner and outer sides, said apparatus comprising:

cover means for covering said ventilation aperture, said cover means having at least one passage therein for communicating ambient air to said aperture;

an inner support section on the inside of said sheet, having at least one passage therein in fluid communication with said ventilation aperture and said first mentioned passage;

means coupling said cover means and said lower section to secure said cover means and said lower section to said outer and inner sides of said sheet;

said cover means and said inner section including cooperating detent and detent receiving means for clamping to opposite sides of said sheet;

said cover means comprising a first annular plate, having an opening therethrough, in alignment with said aperture;

said detent receiving means comprising an annular recess in said first plate;

said inner section including a second annular plate;

said detent comprises an annular sheet retaining rib, mounted on said second annular plate, received by said annular recess; and extensible and retractable support means coupled to said inner support section for supporting said ventilator apparatus at any selected one of a plurality of different levels to position the portion of said sheet adjacent said aperture at any selected one of a plurality of different levels relative to the edge portions of said sheet.

3. The combination set forth in claim 2 wherein said inner section includes a hollow cylinder mounted on said plate and including a plurality of air transmitting apertures therein in fluid communication with said opening, said cylinder including a cylindrical end portion removably mounted on support means.

4. Ventilator apparatus for a flexible sheet, such as a boat covering, having a ventilation aperture through a portion of said sheet intermediate edge portions of said sheet, said covering having inner and outer sides, said apparatus comprising:

cover means for covering said ventilation aperture comprising:

a first annular plate having a second aperture therein aligned with said ventilation aperture;

a cover plate; and spacer means mounting said cover plate in vertically spaced relation with said first annular plate, said spacer means including at least one passage therein, in fluid communication with said second aperture, for communicating ambient air to said second aperture and said ventilation aperture;

an inner support section on the inside of said sheet, having at least one passage therein in fluid communication with said ventilation aperture and said first mentioned passage;

means for coupling said cover means and said lower section to secure said first annular plate and said inner section to said outer and inner sides, respectively, of said sheet;

said first annular plate and said inner section include complimentally formed sheet pinching aligning portions for displacing portions of said sheet to inhibit movement of said ventilator apparatus relative to said sheet; and extensible and retractable support means, coupled to said inner support section, for supporting said ventilator apparatus at any selected one of a plurality of different levels relative to the edge portions of said sheet.

5. The combination set forth in claim 4 wherein said inner section includes a second annular plate in juxtaposition with said first plate; one of said first and second annular plates including a sheet clamping, projecting rib for displacing a portion of said sheet and the other of said first and second annular plates includes a complimental recess for receiving the displaced portion of said sheet and said rib.

6. The combination set forth in claim 5 wherein said extensible and retractable support means comprises first and second telescopically mounted sections and means for clamping said sections together in any one of a plurality of different positions.

7. Ventilator apparatus for a flexible sheet, such as a boat covering, having a ventilation aperture through a portion of said sheet intermediate edge portions of said sheet, said covering having inner and outer sides, said apparatus comprising:

cover means for covering said ventilation aperture, said cover means having at least one passage therein for communicating ambient air to said aperture;

an inner support section on the inside of said sheet, having at least one passage therein in fluid communication with said ventilation aperture and said first mentioned passage;

means coupling said cover means and said lower section to secure said cover means and said inner section to said outer and inner side, respectively, of said sheet;

said cover means and said inner section including cooperating, sheet-pinching detent means and detent receiving means, clamped to opposite sides of said sheet, for displacing a portion of said sheet out of the plane of said sheet to inhibit lateral movement of said ventilator apparatus relative to said sheet; and extensible and retractable support means coupled to said inner support section for supporting said ventilator apparatus at any selected one of a plurality of different levels to position the portion of said sheet adjacent said aperture at any selected one of a plurality of different levels relative to the edge portions of said sheet.

8. The combination set forth in claim 7 wherein said cover means comprises a first annular plate, having an opening therethrough, in alignment with said ventilation aperture; said detent receiving means comprising an annular recess in said first plate; said inner section including a second annular plate; said detent comprising an annular sheet displacing rib, mounted on said second annular plate, received by said annular recess.

9. The combination set forth in claim 8 wherein said inner section includes a hollow cylinder coupled to said plate and including a plurality of air transmitting apertures therein in fluid communication with said opening, said cylinder including a cylindrical end portion removably mounted on support means.

10. In combination with a flexible sheet having upper and lower sides and a ventilation aperture therethrough, and means for securing edge portions of said sheet to an object such as a boat or the like, comprising:

ventilator apparatus having at least one passage therein for communicating ambient air to said aperture, including:

means on the upper side of said sheet for covering said aperture; and extensible and retractable support means on said object for supporting said ventilation apparatus at any selected one of a plurality of different levels to position the midportion of said sheet at any selected one of a plurality of different levels above the adjacent sheet portions;

said covering means comprising:

a first annular plate having an opening therein aligned with said aperture;

a cover plate overlying said first annular plate; and spacer means mounting said cover plate in vertically spaced relation with said annular plate;

said passage being provided in said spacer means;

said ventilator apparatus further including:

a lower section comprising:

a second annular plate abutting the underside of said sheet and including an opening therethrough aligned with said aperture; and means coupling said first and second annular plates together to sandwich a portion of said sheet adjacent said aperture therebetween;

one of said covering means and said lower section including detent means and the other of said covering means and said lower sections including detent receiving means for receiving said detent means to properly align said covering means relative to said lower section; one of said annular plates including sheet pinching projecting rib means for displacing a section of the sheet, and the other of said annular plates including a complimentally formed recess for receiving the displaced section of said sheet and said rib means.

* * * * *